US007140771B2

(12) United States Patent
Leek

(10) Patent No.: US 7,140,771 B2
(45) Date of Patent: Nov. 28, 2006

(54) X-RAY PRODUCING DEVICE WITH REDUCED SHIELDING

(76) Inventor: Paul H. Leek, 70 Acorn Hill Rd., Woodbridge, CT (US) 06525

( * ) Notice: Subject to any disclaimer, the term of this patent is extended or adjusted under 35 U.S.C. 154(b) by 0 days.

(21) Appl. No.: 10/946,783

(22) Filed: Sep. 22, 2004

(65) Prior Publication Data

US 2005/0078796 A1 Apr. 14, 2005

Related U.S. Application Data

(60) Provisional application No. 60/504,416, filed on Sep. 22, 2003.

(51) Int. Cl.
*H01J 35/16* (2006.01)
*H01J 35/12* (2006.01)

(52) U.S. Cl. ..... 378/203; 378/119; 378/200

(58) Field of Classification Search ..... 378/203, 378/119, 199, 200
See application file for complete search history.

(56) References Cited

U.S. PATENT DOCUMENTS

| | | | | |
|---|---|---|---|---|
| 3,508,059 | A * | 4/1970 | Vanderpool | 378/203 |
| 4,324,980 | A * | 4/1982 | Symmons | 250/505.1 |
| 4,352,196 | A | 9/1982 | Gabbay | |
| 4,715,054 | A | 12/1987 | Kato et al. | |
| 4,816,127 | A | 3/1989 | Eltoukhy | |
| 4,910,759 | A | 3/1990 | Sharnoff | |
| 4,988,919 | A * | 1/1991 | Tanabe et al. | 315/505 |
| 5,463,268 | A | 10/1995 | Schroeder | |
| 6,000,847 | A | 12/1999 | Close et al. | |
| 6,108,397 | A | 8/2000 | Cash, Jr. | |
| 6,172,463 | B1 * | 1/2001 | Cutler et al. | 315/505 |
| 6,429,426 | B1 | 8/2002 | Döring | |
| 6,580,084 | B1 | 6/2003 | Hiramoto et al. | |
| 6,674,838 | B1 | 1/2004 | Barrett | |
| 6,711,235 | B1 | 3/2004 | Galish et al. | |
| 6,760,407 | B1 | 7/2004 | Price et al. | |
| 2004/0057554 | A1 * | 3/2004 | Bjorkholm | 378/143 |

FOREIGN PATENT DOCUMENTS

JP 05129097 A * 5/1993

OTHER PUBLICATIONS

Bjorkholm, Paul J., "Dual Energy Detection of Weapons of Mass Destruction", Port Technology International, pp. 1-3, vol. PT22-6/4.
Schriber, S. O., "Comparison of Standing Wave Accelerators Operating in the 2(pi)/3 and (pi)/2 Modes", IEEE Transactions on Nuclear Science, (1975), pp. 1343-1349, vol. NS-22.
Vorogushin, M. F. "Experiments on Material Recognition for 8 MEV Customs Inspection System for Trucks and Large-Scale Containers", XX International Linac Conference, No. TUE13, pp. 642-644 (2000).

* cited by examiner

*Primary Examiner*—Edward J. Glick
*Assistant Examiner*—Chih-Cheng Glen Kao
(74) *Attorney, Agent, or Firm*—Holland & Bonzagni, P.C.; Mary R. Bonzagni, Esq.

(57) ABSTRACT

A method for reducing the amount of shielding used in radiation sources, as well as, an improved radiation source (e.g., an x-ray producing device), are provided. The inventive method involves placement of a radiation producing target at the end of a vacuum drift tube and closer to and substantially in the center of a shield for blocking radiation emitted from the radiation producing target.

18 Claims, 6 Drawing Sheets

In line coupled accelerator with 10" shielding side coupled accelerator with 10" shielding In line coupled accelerator with 10" shielding

X-RAY PRODUCING DEVICE WITH REDUCED SHIELDING

RELATED APPLICATION

This application claims priority from U.S. Provisional Patent Application Ser. No. 60/504,416, filed Sep. 22, 2003, which is hereby incorporated by reference.

FIELD OF THE INVENTION

The present invention relates generally to a method for reducing the amount of shielding used in radiation sources such as x-ray producing devices, and further relates to an improved radiation source where the weight of the shielding has been minimized.

BACKGROUND AND SUMMARY OF THE INVENTION

X-ray producing devices are extremely effective and valuable tools that are used in a wide variety of industrial and medical applications. While used in a number of different applications, the basic operation of these devices is similar.

Generally speaking, x-rays are produced when electrons are accelerated and then impinged upon a material of a particular composition. This process is typically carried out within a vacuum enclosure formed as part of the x-ray producing device. Disposed within the evacuated enclosure is an electron generator (i.e., cathode), and an anode, which is spaced apart from the cathode. In operation, electrical power is applied to a filament portion of the cathode, causing electrons to be emitted. A high voltage potential is placed between the cathode and the anode, causing the emitted electrons to accelerate towards a target surface on the anode. Typically, the electrons are "focused" into an electron beam towards a desired "focal spot" located on the target surface.

During operation of the x-ray producing device, the electrons in the beam strike the target surface at a high velocity. The target surface on the target anode is composed of a material having a high atomic number, and a small portion of the kinetic energy of the striking electron stream is thus converted to x-rays, which are electromagnetic waves of very high frequency. The resulting x-rays, which emanate from the target surface in all directions, are blocked using heavy metal shielding and collimated through a window formed in the shielding for penetration into an object.

By way of the present invention, it has been discovered that the amount of heavy metal shielding used in radiation sources such as x-ray producing devices may be reduced by placing the radiation producing target closer to and substantially in the center of shielding adopting, for example, a spherical or substantially spherical geometry. The relocation of the target in these sources or devices is made possible by the use of a vacuum drift tube.

The present invention therefore generally provides a method for reducing the amount of shielding used in radiation sources such as x-ray producing devices, which basically comprises: placing a radiation producing target at the end of a vacuum drift tube and substantially in the center of a shield for blocking radiation emitted from the target.

The present invention further generally provides a radiation source such as an x-ray producing device, which basically comprises: a vacuum drift tube; a radiation producing target; and a shield for blocking radiation emitted from the radiation producing target, wherein the radiation producing target is located at the end of the drift tube and substantially in the center of the shield.

The present invention more particularly provides an improved x-ray producing device, which comprises:

(1) an electron accelerator structure defining an electron flow path and having an electron injection end and an electron exit end;

(2) an electron gun having an electron source, which is located at the injection end of the electron accelerator structure, for producing and delivering a stream of electrons to the accelerator structure;

(3) a vacuum drift tube having a first end and a second end, wherein the first end of the drift tube is located at the electron exit end of the accelerator structure;

(4) a target located at the second end of the vacuum drift tube for producing x-rays from electrons striking a surface of the target; and (5) a shield located around the drift tube for blocking x-rays emitted from the target, wherein the shield has one or more openings for forming an x-ray beam having a pre-selected cross section from the x-rays emitted from the target, wherein, the target is located substantially at the center of the shield.

The present invention further provides a radiation (e.g., x-ray) inspection or imaging system that employs the radiation source described above. The inventive system is a lighter weight system and thus particularly advantageous for portable or mobile system applications.

Other features and advantages of the invention will be apparent to one of ordinary skill from the following detailed description and drawings.

Unless otherwise defined, all technical and scientific terms used herein have the same meaning as commonly understood by one of ordinary skill in the art to which this invention belongs. All publications, patent applications, patents and other references mentioned herein are incorporated by reference in their entirety. In case of conflict, the present specification, including definitions, will control. In addition, the materials, methods, and examples are illustrative only and not intended to be limiting.

BRIEF DESCRIPTION OF THE DRAWINGS

In the course of the description which follows, reference is made to the drawings, in which.

BEST MODE FOR CARRYING OUT THE INVENTION

By way of the present invention, shielding is moved closer to a target used in a radiation source or x-ray producing device resulting in a reduction in the size and overall weight of the shielding. The shielding weight reduction achieved by way of this invention results in a reduction in the total weight of the radiation source or x-ray producing device that ranges from about 30 to about 50%. As such, the inventive device is particularly suitable for use in portable or mobile inspection or imaging systems.

Figure 1:
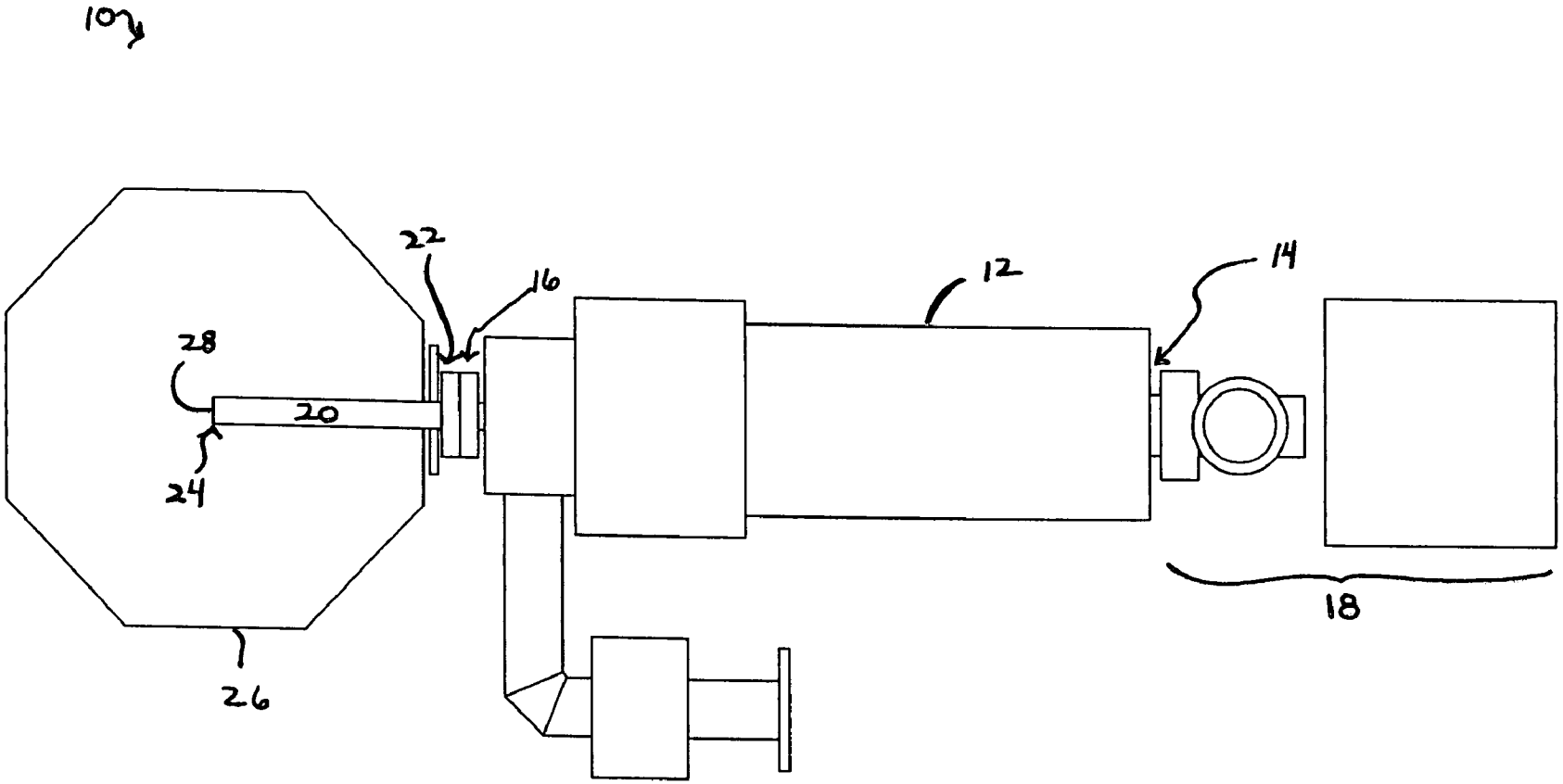
FIG. 1 is a simplified schematic diagram of a preferred embodiment of the improved x-ray producing device of the present invention.

Referring now to FIG. 1, a preferred embodiment of the improved x-ray producing device of the present invention is shown generally at 10. Device 10 basically comprises:

(1) a shielded electron accelerator structure 12 defining an electron flow path and having an electron injection end 14 and an electron exit end 16;

(2) a shielded electron gun 18 having an electron source, which is located at the injection end 14 of the electron accelerator structure 12, for producing and delivering a stream of electrons to accelerator structure 12;

(3) a vacuum drift tube 20 having a first end 22 and a second end 24, wherein the first end 22 of the drift tube 20 is located at the electron exit end 16 of the accelerator structure 12;

(4) a shield 26 located around the drift tube 20 for blocking x-rays emitted from a target 28, wherein the shield 26 has one or more openings (not shown) for forming an x-ray beam having a pre-selected cross section from the x-rays emitted from target 28; and (5) target 28 located at the second end 24 of the drift tube 20 and substantially at the center of the shield 26, for producing x-rays from electrons striking a surface of target 28.

The improved x-ray producing device 10 of the present invention operates as follows: The electron gun 18 produces a beam of energetic particles or electrons directed toward the electron accelerator structure 12, which in turn accelerates these particles toward target 28 located at the second end 24 of drift tube 20. The electrons in the beam strike the surface of target 28, causing x-rays to be emitted from a side of target 28 opposite from the electron collision. The emitted x-rays are blocked by shield 26 and collimated through the one or more openings in shield 26 for penetration into an object.

The electron accelerator structure 12 of the improved x-ray producing device 10 of the present invention is known and, in one embodiment, is an elongate accelerator structure that defines a linear electron flow path. Such an accelerator structure is generally made up of two basic sections, namely, a coupler section, and an accelerator section. The coupler section is a device that serves to transmit microwave power into the accelerator section. The accelerator section is composed of a series of identical cavities in which the transmitted microwave power is used to accelerate an electron beam. The cavities are brazed together to establish good electrical contact for the flow of microwave current and to provide an ultra-high vacuum seal.

Figure 2A:
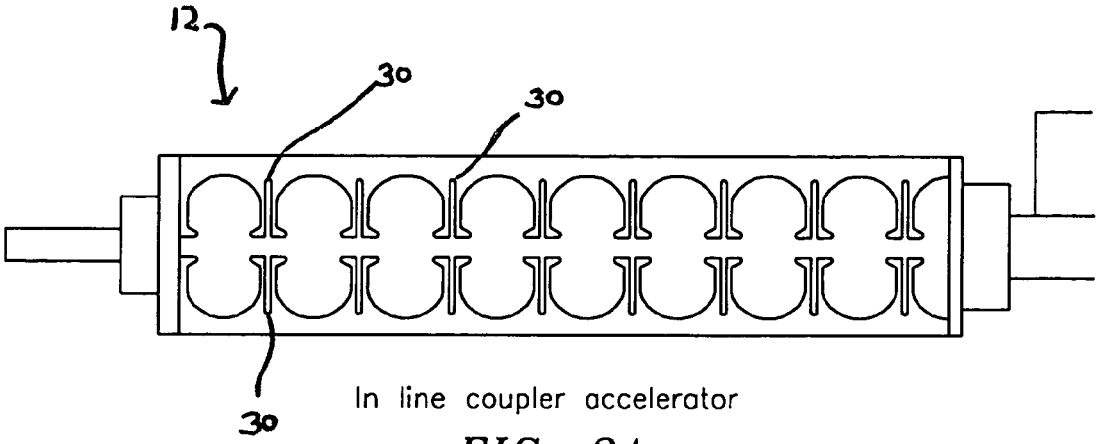
FIG. 2A is a simplified schematic diagram of a preferred electron accelerator structure for use in the improved x-ray producing device of the present invention, where the coupler section of the accelerator structure is made up of a series of in line couplers.
Figure 2B:
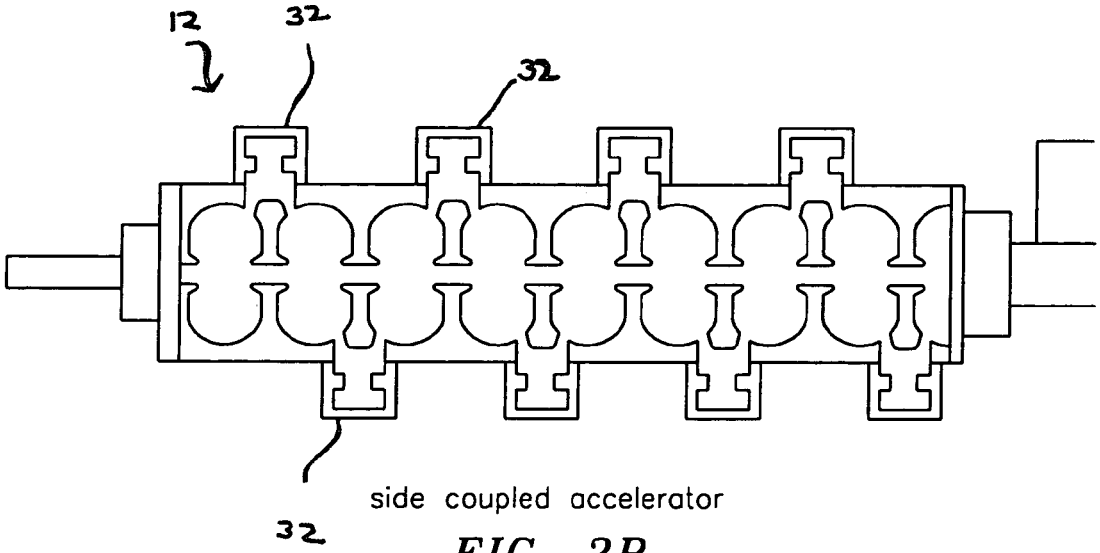
FIG. 2B is a simplified schematic diagram of another electron accelerator structure, where the coupler section is made up of a series of side couplers.

In a preferred embodiment, which is best shown in FIG. 2A, the coupler section of accelerator structure 12 is made up of a series of in line couplers 30 instead of side couplers 32, which are shown in FIG. 2B. More specifically, in the preferred embodiment shown in FIG. 2A, accelerator structure 12 is provided with in line "pancake" couplers 30 that are located in the walls between the cavities in the accelerator section. Electron accelerator structures employing such an in line coupler design are described in S. O. Schriber, *IEEE Transactions on Nuclear Science*, Vol. NS-22, page 1343 (June 1975), which is incorporated herein by reference.

Figure 3A:
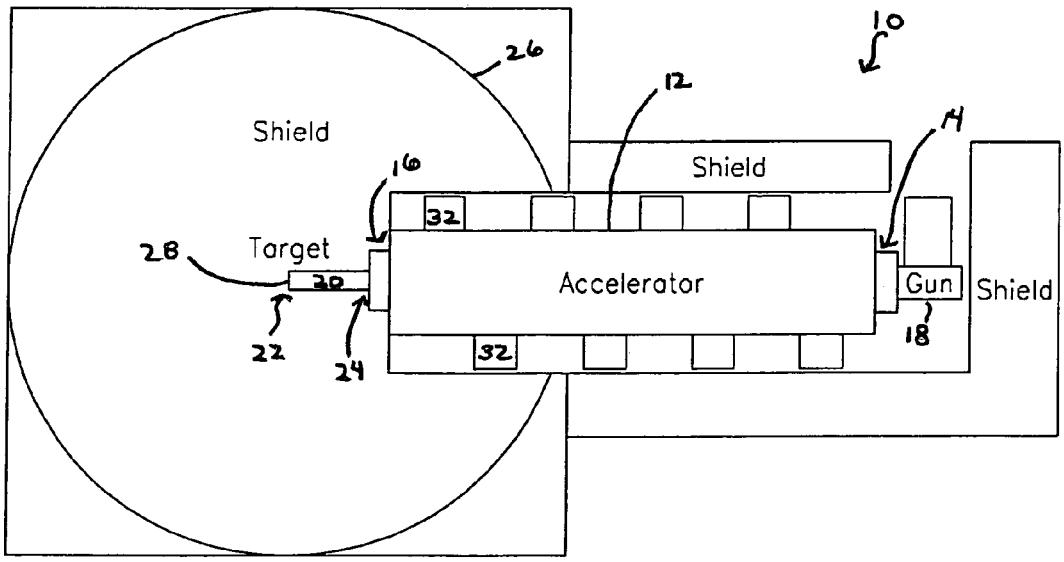
FIG. 3A is a simplified schematic diagram of an embodiment of the inventive improved x-ray producing device, where the electron accelerator structure employs a coupler section made up of a series of side couplers.
Figure 3B:
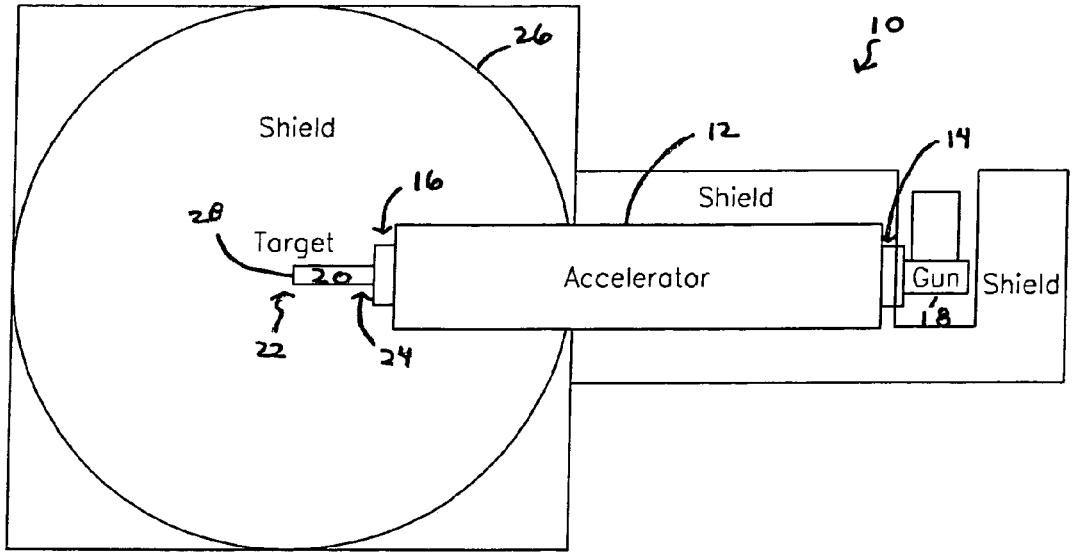
FIG. 3B is a simplified schematic diagram of a preferred embodiment of the inventive improved x-ray producing device, where the electron accelerator structure employs a coupler section made up of a series of in line couplers.

Referring now to FIGS. 3A and 3B, a comparison of the x-ray producing devices shown in these figures, which employ either a side coupled or in line coupled accelerator 12, will indicate that less shielding material (e.g., lead, heavy alloy) is needed when the accelerator design contains in line couplers, due to the obvious decrease in the outside diameter of accelerator structure 12.

The electron gun 18 of the improved x-ray producing device 10 of the present invention is also known and, in one embodiment, is a triode gun that produces a pulsed electron beam and comprises an electron source (e.g., cathode), a focus electrode, an accelerating electrode, and a control grid placed between the electron source and accelerating electrode, to control the flow of electrons through the gun body.

The vacuum drift tube 20 of the improved x-ray producing device 10 of the present invention serves as a connecting passage for carrying the electron beam to target 28, thereby allowing target 28 to be placed closer to and substantially in the center of shield 26.

As is well known to those skilled in the art, the kinetic energy resulting from the electrons striking a target produces a significant amount of heat in the target and surrounding region. As a result, the area of the target typically experiences extremely high operating temperatures. This heat can cause the expansion of drift tube components, thereby modifying the geometry of the drift tube and the dynamics of the charged particle or electron beam, including its frequency.

In one embodiment contemplated by the present invention, a drift tube employing a novel means for cooling target 28 and the surrounding region is provided. More specifically, the vacuum drift tube 20 employed with improved x-ray producing device 10 basically comprises:

(a) an inner vacuum tube;

(b) an outer tube concentric with and spaced from the inner vacuum tube; and (c) means for directing cool water through the space defined by the inner and outer tubes to target 28.

Figure 4:
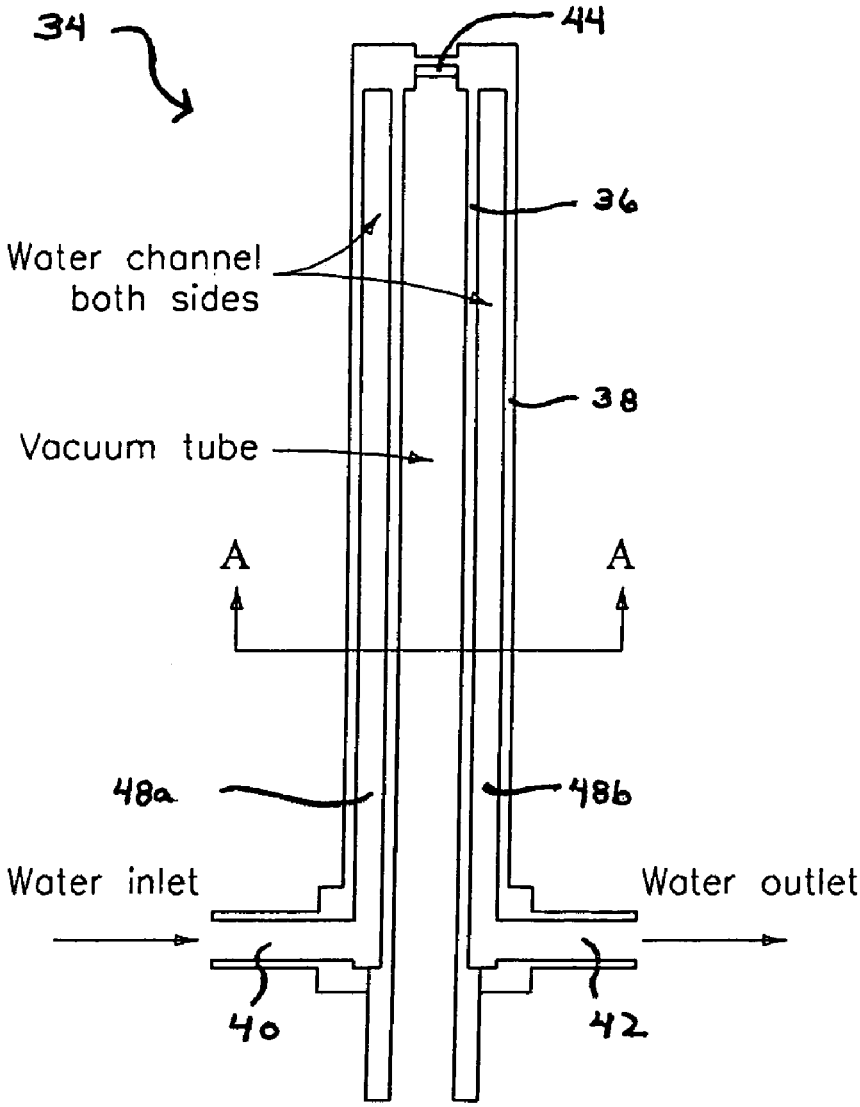
FIG. 4 is a cross-sectional view of a preferred embodiment of the vacuum drift tube of the inventive improved x-ray producing device.
Figure 5:
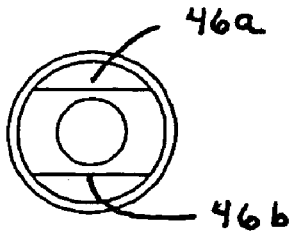
FIG. 5 is a cross-sectional view of the vacuum drift tube of FIG. 4, taken along lines A—A.

Referring now to FIGS. 4 and 5, a preferred vacuum drift tube is shown generally at 34, and basically comprises:

(a) an inner vacuum tube 36;

(b) an outer tube 38 concentric with and spaced from the inner vacuum tube 36;

(c) a water inlet port 40 communicating with the space defined by the inner vacuum tube 36 and the outer tube 38;

(d) a water outlet port 42 communicating with the exterior of the vacuum drift tube 34;

(e) a target 44 for producing x-rays from electrons striking its surface;

(f) baffles or diverters 46*a,b* (FIG. 5) extending longitudinally within the space defined by the inner vacuum tube 36 and the outer tube 38, for directing water toward and away from target 44; and (g) water channels 48*a,b* formed by diverters 46*a,b*.

In operation, water enters inlet port 40 and passes down water channel 48*a* toward target 44. Diverter 46*a* extends longitudinally within the space between the inner and outer tubes 36, 38, and forms water channel 48*a*, while diverter 46*b* extends longitudinally within the space between the inner and outer tubes 36, 38, and forms water channel 48*b*. Diverters 46*a,b* end prior to reaching target 44, allowing water to pass within from about 3 to about 10 millimeters (mm) of target 44 before passing to the other side of tube 34 and down to the water outlet port 42. The shape of water channels 48*a,b* and the abrupt connection of these channels near the target area ensures maximum turbulence for effective cooling. A further advantage is that the target 44 or target area can be made completely axially symmetric and thus will throw no shadows when used as an anode for panoramic applications.

In a preferred embodiment, the inner vacuum tube 36 of the vacuum drift tube 34 is comprised of copper and measures from about 50 to about 250 mm in length, from about 5 to about 20 mm in inner diameter, and from about 15 to about 30 mm in outer diameter, while outer tube 38 is comprised of either copper, an alloy of nickel, copper, and manganese (e.g., MONEL 400 alloy), or stainless steel and measures from about 50 to about 250 mm in length, from about 15 to about 30 mm in inner diameter, and from about 17 to about 35 mm in outer diameter. In this preferred embodiment, target 44 is prepared from a circular piece of tungsten measuring from about 5 to about 10 mm in diameter and from about 0.5 to about 3 mm in total thickness.

Shield 26 of the improved x-ray producing device 10 of the present invention is located around the drift tube 20 and has one or more openings for forming an x-ray beam having a pre-selected cross section.

The surface configuration or shape of shield 26 is not limited. The surface may be curved in two or three dimensions. For example, the surface may have a spherical shape. Alternatively, the surface may be curved along a first axis and straight along a second axis which is orthogonal to the first axis (e.g., cylindrical), curved in two dimensions with different radii in the two directions, or a surface with variable curvature over its area.

Figure 6:
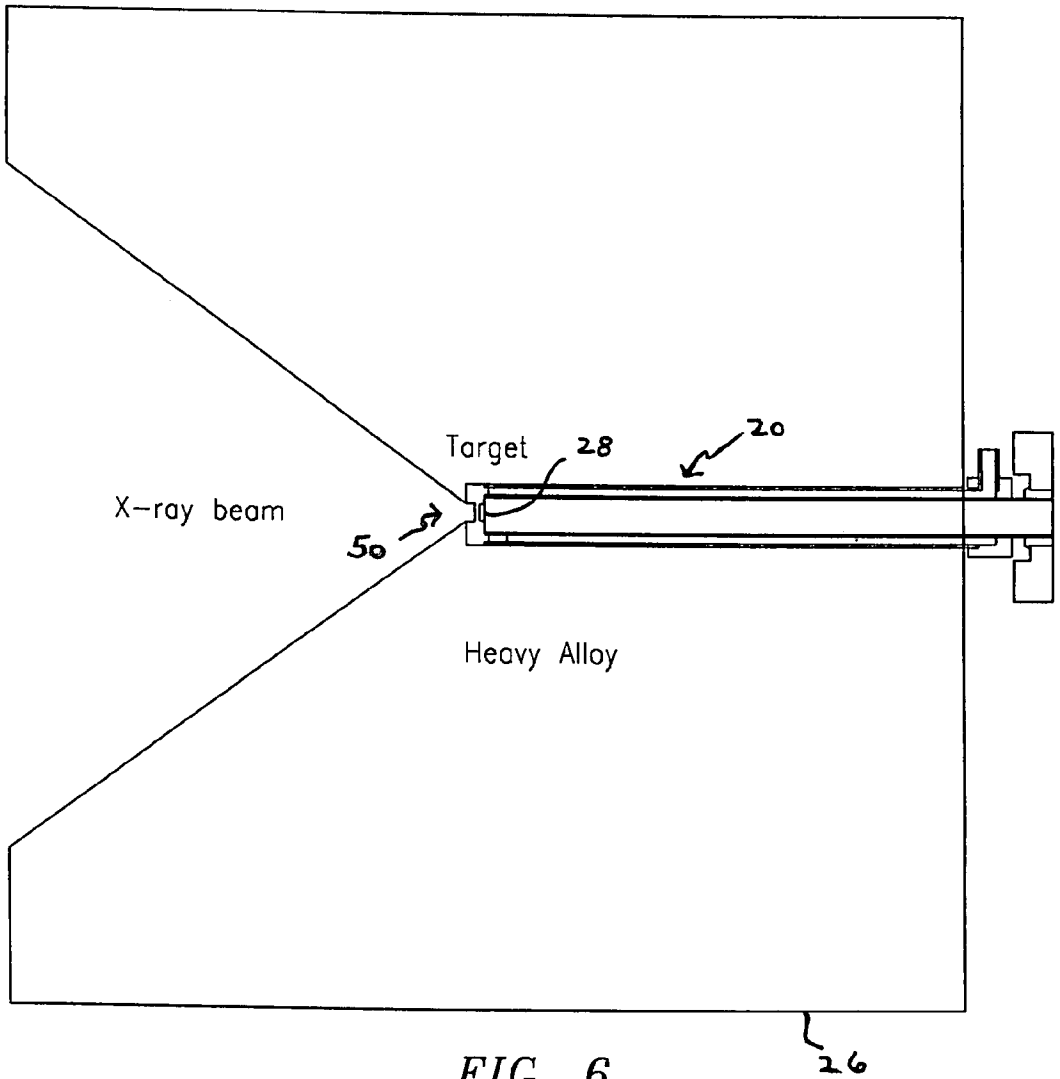
FIG. 6 is a simplified schematic diagram of a preferred embodiment of the vacuum drift tube and shield of the improved x-ray producing device of the present invention, where the shield has a cylindrical surface configuration or shape and a substantially circular cross-section.

In one contemplated embodiment, which is best shown in FIG. 6, shield 26 has a cylindrical surface configuration or shape. In this embodiment, shield 26 has an opening 50, which facilitates the formation of a conical x-ray beam having a substantially circular cross section from x-rays emitted from target 28.

Figure 7:
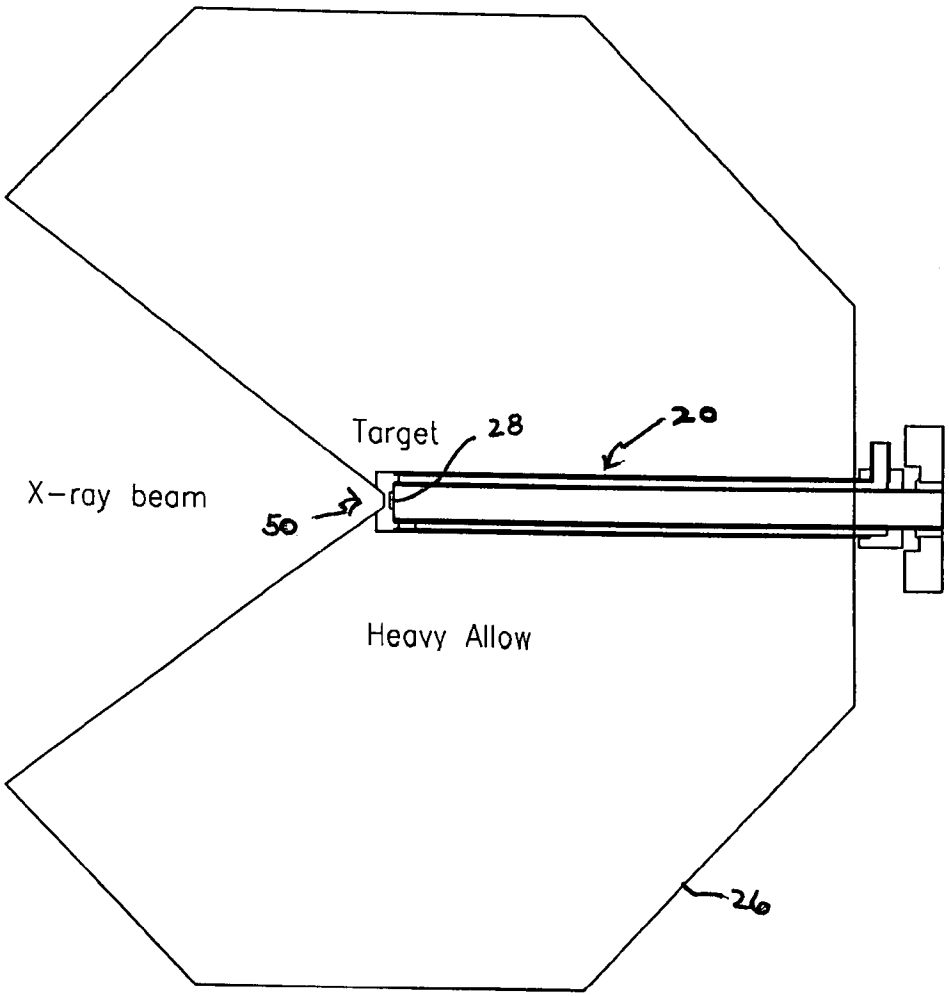
FIG. 7 is a simplified schematic diagram of another preferred embodiment of the vacuum drift tube and shield of the inventive improved x-ray producing device, where the shield has a double truncated cylindrical surface configuration or shape with a regular octagonal cross section that approximates to a sphere.

In another contemplated embodiment, which is best shown in FIG. 7, shield 26 has a double truncated cylindrical surface configuration or shape with a regular octagonal cross section that approximates to a sphere. As in the previous embodiment shown in FIG. 6, the shield 26 shown in FIG. 7 also has an opening 50, which facilitates the formation of a conical x-ray beam with a substantially circular cross section from x-rays emitted from target 28.

As noted above, the one or more openings in shield 26 allow for the formation of an x-ray beam having a pre-selected cross section. Preferably, the pre-selected cross section of the x-ray beam is either a circular or rectangular cross section. In another preferred embodiment, the x-ray beam emanating from the one or more openings in shield 26 is in the form of long thin rectangles that approximate a line.

Materials suitable for use in making shield 26 include, but are not limited to, lead, lead alloys, steel, steel alloys, tungsten and tungsten alloys, with preferred materials being lead and tungsten alloys.

In a preferred embodiment, shield 26 comprises a cylindrical inner core prepared from a tungsten alloy. The inner core has an inner diameter ranging from about 15 to about 30 mm, an outer diameter ranging from about 100 to about 200 mm, and a length ranging from about 100 to about 400 mm, and is encased in a lead cylinder having an inner diameter ranging from about 100 to about 200 mm, an outer diameter ranging from about 250 to about 700 mm, and a length ranging from about 250 to about 700 mm. Two tungsten alloy plates, each measuring from about 100 to about 300 mm in length, from about 100 to about 300 mm in width, and from about 10 to about 30 mm in total thickness, are used to structure an opening in shield 26 that serves to form a narrow x-ray beam from the emitted x-rays that has a long, narrow, rectangular cross section. More specifically, identical wedges are engraved or machined into a surface of each tungsten alloy plate, and the plates assembled together with the machined surfaces facing inward thereby forming a wedge-shaped slot. The resulting assembly is then inserted into and affixed to shield 26 so that the apex of the wedge-shaped slot is located next to target 28 at the second end 24 of the drift tube 20, while the side opposite the apex is located at a surface of shield 26.

Target 28 of the improved x-ray producing device 10 of the present invention is located at the second end 24 of the drift tube 20 and substantially at the center of shield 26, and produces x-rays from electrons striking the surface of the target 28. As will be readily evident to those skilled in the art, the inventive x-ray producing device 10 operates in a transmission mode because x-rays are emitted from a side of the target 28 opposite from the electron collision.

The target 28 basically comprises an element having an atomic number greater than 72 and in a preferred embodiment is a transmission target.

In a more preferred embodiment, the target 28 comprises a material having good vacuum characteristics and the ability to withstand high heat and electron bombardment, and more particularly comprises a tungsten "button" having a diameter ranging from about 4 to about 10 mm, and a total thickness ranging from about 0.5 to about 4.0 mm. The tungsten "button" is brazed onto a copper disk having a diameter ranging from about 15 to about 25 mm, and a total thickness ranging from about 8 to about 20 mm. The copper disk with brazed tungsten "button" is brazed onto the second end 24 of the drift tube 20.

As noted above, by way of the present invention it has been discovered that an x-ray target may be placed closer to and substantially in the center of a shield adopting, for example, a spherical or substantially spherical geometry, by placing the x-ray target at the end of a drift tube. As a result, the weight and cost of the shielding is minimized.

While various embodiments of the present invention have been described above, it should be understood that they have been presented by way of example only, and not limitation. Thus, the breadth and scope of the present invention should not be limited by any of the exemplary embodiments.

What is claimed is:

1. A method for reducing an amount of shielding used in a radiation source and for minimizing expansion of vacuum drift tube components, wherein the radiation source includes an electron accelerator structure having an electron exit end, which method comprises: placing one end of a vacuum drift tube at the electron exit end of the accelerator structure; placing a radiation producing target at an opposing end of the vacuum drift tube and substantially in a center of a shield for blocking radiation emitted from the target; and providing means for directly cooling the vacuum drift tube and the target during operation of the radiation source, wherein cooling fluid is delivered to the vacuum drift tube near an outer surface of the shield.

2. The method of claim 1, wherein the radiation source is an x-ray producing device, and wherein the radiation producing target is an x-ray producing target.

3. A radiation source having a reduced amount of shielding, which comprises: an electron accelerator structure having an electron exit end; a vacuum drift tube having opposing first and second ends; a radiation producing target; and a shield for blocking radiation emitted from the radiation producing target, wherein the first end of the vacuum drift tube is located at the electron exit end of the electron accelerator structure, wherein the radiation producing target is located at the second end of the vacuum drift tube and substantially in a center of the shield, wherein the vacuum drift tube employs means for directly cooling the vacuum drift tube and the radiation producing target during operation of the radiation source, and wherein cooling fluid is delivered to the vacuum drift tube near an outer surface of the shield.

4. The radiation source of claim 3, wherein the radiation source is an x-ray producing device, and wherein the radiation producing target is an x-ray producing target.

5. An improved x-ray producing device, which comprises:

(a) an electron accelerator structure defining an electron flow path and having an electron injection end and an electron exit end;

(b) an electron gun having an electron source, which is located at the injection end of the electron accelerator structure, for producing and delivering a stream of electrons to the accelerator structure;

(c) a vacuum drift tube having a first end and a second end, wherein the first end of the drift tube is located at the electron exit end of the accelerator structure;

(d) a target located at the second end of the vacuum drift tube for producing x-rays from electrons striking a surface of the target; and (e) a shield located around the drift tube for blocking x-rays emitted from the target, wherein the shield has one or more openings for forming an x-ray beam having a pre-selected cross section from the x-rays emitted from the target, wherein the target is located substantially at a center of the shield, wherein the vacuum drift tube employs means for directly cooling the vacuum drift tube and the target during operation of the x-ray producing device and wherein cooling fluid is delivered to the vacuum drift tube near an outer surface of the shield.

6. The improved x-ray producing device of claim 5, wherein the electron accelerator structure is an in line coupled electron accelerator structure that comprises: an accelerator section; and a coupler section, wherein the accelerator section has a length and comprises at least one wall that forms a plurality of adjacent cavities that extend along the length of the accelerator section, wherein the coupler section comprises a plurality of coupling devices, wherein one coupling device is located between each set of adjacent cavities of the accelerator section of the electron accelerator structure.

7. The improved x-ray producing device of claim 5, wherein the vacuum drift tube comprises:

(a) an inner vacuum tube;

(b) an outer tube concentric with and spaced from the inner vacuum tube, thereby forming a space between the inner and outer tubes; and (c) means for directing cool water through the space defined by the inner and outer tubes to the target.

8. The improved x-ray producing device of claim 5, wherein the vacuum drift tube has an exterior surface, and comprises:

(a) an inner vacuum tube;

(b) an outer tube concentric with and spaced from the inner vacuum tube, thereby forming a space between the inner and outer tubes;

(c) a water inlet port communicating with the space defined by the inner and outer tubes;

(d) a water outlet port communicating with the exterior surface of the vacuum drift tube;

(e) a target for producing x-rays from electrons striking its surface;

(f) diverters extending longitudinally within the space defined by the inner and outer tubes, for directing water toward and away from the target; and (g) water channels formed by the diverters.

9. The improved x-ray producing device of claim 5, wherein the shield has a spherical surface configuration or shape.

10. The improved x-ray producing device of claim 5, wherein the shield has a cylindrical surface configuration or shape.

11. A radiation inspection or imaging system that comprises a radiation source having a reduced amount of shielding, wherein the radiation source comprises:

a vacuum drift tube having an end; a radiation producing target; and a shield for blocking radiation emitted from the radiation producing target, wherein the radiation producing target is located at the end of the vacuum drift tube and substantially in a center of the shield, wherein the vacuum drift tube employs means for directly cooling the vacuum drift tube and the radiation producing target during operation of the radiation source, and wherein cooling fluid is delivered to the vacuum drift tube near an outer surface of the shield.

12. The radiation inspection or imaging system of claim 11, wherein the radiation inspection or imaging system is an x-ray inspection or imaging system, wherein the radiation source is an x-ray producing device, and wherein the radiation producing target is an x-ray producing target.

13. The radiation inspection or imaging system of claim 12, wherein the x-ray producing device comprises:

(a) an electron accelerator structure defining an electron flow path and having an electron injection end and an electron exit end;

(b) an electron gun having an electron source, which is located at the injection end of the electron accelerator structure, for producing and delivering a stream of electrons to the accelerator structure;

(c) a vacuum drift tube having a first end and a second end, wherein the first end of the drift tube is located at the electron exit end of the accelerator structure;

(d) a target located at the second end of the vacuum drift tube for producing x-rays from electrons striking a surface of the target; and (e) a shield located around the drift tube for blocking x-rays emitted from the target, wherein the shield has one or more openings for forming an x-ray beam having a pre-selected cross section from the x-rays emitted from the target, wherein the target is located substantially at a center of the shield.

14. The radiation inspection or imaging system of claim 13, wherein the electron accelerator structure of the x-ray producing device is an in line coupled electron accelerator structure that comprises: an accelerator section; and a coupler section, wherein the accelerator section has a length and comprises at least one wall that forms a plurality of adjacent cavities that extend along the length of the accelerator section, wherein the coupler section comprises a plurality of coupling devices, wherein one coupling device is located between each set of adjacent cavities of the accelerator section of the electron accelerator structure.

15. The radiation inspection or imaging system of claim 13, wherein the vacuum drift tube of the x-ray producing device comprises:

(a) an inner vacuum tube;

(b) an outer tube concentric with and spaced from the inner vacuum tube, thereby forming a space between the inner and outer tubes; and (c) means for directing cool water through the space defined by the inner and outer tubes to the target.

16. The radiation inspection or imaging system of claim 13, wherein the vacuum drift tube of the x-ray producing device has an exterior surface, and comprises:

(a) an inner vacuum tube;

(b) an outer tube concentric with and spaced from the inner vacuum tube, thereby forming a space between the inner and outer tubes;

(c) a water inlet port communicating with the space defined by the inner and outer tubes;

(d) a water outlet port communicating with the exterior surface of the vacuum drift tube;

(e) a target for producing x-rays from electrons striking its surface;

(f) diverters extending longitudinally within the space defined by the inner and outer tubes, for directing water toward and away from the target; and (g) water channels formed by the diverters.

17. The radiation inspection or imaging system of claim 13, wherein the shield of the x-ray producing device has a spherical surface configuration or shape.

18. The radiation inspection or imaging system of claim 13, wherein the shield of the x-ray producing device has a cylindrical surface configuration or shape.

* * * * *